US011447841B2

(12) United States Patent
Kawasaki et al.

(10) Patent No.: US 11,447,841 B2
(45) **Date of Patent: *Sep. 20, 2022**

(54) HIGH-STRENGTH STEEL SHEET AND METHOD FOR PRODUCING SAME

(71) Applicant: JFE STEEL CORPORATION, Tokyo (JP)

(72) Inventors: Yoshiyasu Kawasaki, Tokyo (JP); Takako Yamashita, Tokyo (JP); Masayasu Ueno, Tokyo (JP); Yuki Toji, Tokyo (JP); Takashi Kobayashi, Tokyo (JP); Yoshimasa Funakawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 736 days.

This patent is subject to a terminal disclaimer.

(21) Appl. No.: 16/349,443

(22) PCT Filed: Nov. 15, 2017

(86) PCT No.: PCT/JP2017/041148

§ 371 (c)(1),
(2) Date: May 13, 2019

(87) PCT Pub. No.: WO2018/092817

PCT Pub. Date: May 24, 2018

(65) Prior Publication Data

US 2019/0271051 A1 Sep. 5, 2019

(30) Foreign Application Priority Data

Nov. 16, 2016 (JP) ..... JP2016-223344

(51) Int. Cl.

| | |
|---|---|
| ***C21D 8/02*** | (2006.01) |
| ***C23C 2/12*** | (2006.01) |
| ***C23C 2/40*** | (2006.01) |
| ***C22C 38/00*** | (2006.01) |
| ***C22C 38/06*** | (2006.01) |
| ***C22C 38/02*** | (2006.01) |
| ***C22C 38/14*** | (2006.01) |
| ***C22C 38/60*** | (2006.01) |
| ***C22C 38/38*** | (2006.01) |
| ***C22C 38/12*** | (2006.01) |
| ***C22C 38/16*** | (2006.01) |
| ***C22C 38/08*** | (2006.01) |
| ***C21D 9/46*** | (2006.01) |
| ***C23C 2/02*** | (2006.01) |
| ***C22C 38/04*** | (2006.01) |
| ***C21D 6/00*** | (2006.01) |
| ***C23C 2/06*** | (2006.01) |

(52) U.S. Cl.

CPC ..... *C21D 8/0247* (2013.01); *C21D 6/005* (2013.01); *C21D 8/0263* (2013.01); *C21D 8/0273* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/38* (2013.01); *C22C 38/60* (2013.01); *C23C 2/02* (2013.01); *C23C 2/06* (2013.01); *C23C 2/12* (2013.01); *C23C 2/40* (2013.01); *C21D 8/0205* (2013.01); *C21D 8/0226* (2013.01); *C21D 8/0236* (2013.01); *C21D 2211/001* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 7,413,617 | B2 | 8/2008 | Ikeda et al. |
| 9,580,779 | B2 | 2/2017 | Kawasaki et al. |
| 9,758,848 | B2 | 9/2017 | Kawasaki et al. |

(Continued)

FOREIGN PATENT DOCUMENTS

| | | | |
|---|---|---|---|
| JP | S61157625 | A | 7/1986 |
| JP | H01259120 | A | 10/1989 |

(Continued)

OTHER PUBLICATIONS

Feb. 13, 2018, International Search Report issued in the International Patent Application No. PCT/JP2017/041148.

(Continued)

*Primary Examiner* — Anthony M Liang

(74) *Attorney, Agent, or Firm* — Kenja IP Law PC

(57) ABSTRACT

To provide a high-strength steel sheet with excellent ductility and hole expansion formability, a yield ratio of less than 68%, and a tensile strength of 590 MPa or more, by having a predetermined chemical composition and a microstructure where ferrite is 35% or more and 80% or less and martensite is 5% or more and 25% or less in area ratio, retained austenite is 8% or more in volume fraction, the average grain size of ferrite, martensite and retained austenite is 6.0 μm or less, 3.0 μm or less and 3.0 μm or less respectively, the average aspect ratio of crystal grain of ferrite, martensite and retained austenite is each more than 2.0 and 15.0 or less, and the value obtained by dividing the Mn content (mass %) in retained austenite by the Mn content (mass %) in ferrite is 2.0 or more.

9 Claims, No Drawings

(56) References Cited

U.S. PATENT DOCUMENTS

| | | | | |
|---|---|---|---|---|
| 10,550,446 | B2 * | 2/2020 | Kawasaki | C23C 2/12 |
| 10,711,333 | B2 * | 7/2020 | Kawasaki | C23C 2/28 |
| 10,954,578 | B2 * | 3/2021 | Kawasaki | C23C 2/06 |
| 2005/0081966 | A1 | 4/2005 | Kashima et al. | |
| 2008/0131305 | A1 | 6/2008 | Okitsu | |
| 2008/0302452 | A1 | 12/2008 | Siekmeyer et al. | |
| 2010/0132849 | A1 | 6/2010 | Takagi et al. | |
| 2011/0139315 | A1 | 6/2011 | Nakagaito et al. | |
| 2013/0032253 | A1 | 2/2013 | Kariya et al. | |
| 2014/0056753 | A1 | 2/2014 | Naitou et al. | |
| 2014/0230971 | A1 | 8/2014 | Kawasaki et al. | |
| 2014/0242416 | A1 | 8/2014 | Matsuda et al. | |
| 2016/0222485 | A1 | 8/2016 | Murakami et al. | |
| 2016/0237515 | A1 | 8/2016 | Kajihara et al. | |
| 2017/0298482 | A1 | 10/2017 | Kawasaki et al. | |
| 2017/0306435 | A1 | 10/2017 | Kawasaki et al. | |
| 2017/0314091 | A1 | 11/2017 | Kawasaki et al. | |

FOREIGN PATENT DOCUMENTS

| | | | |
|---|---|---|---|
| JP | 2003138345 | A | 5/2003 |
| JP | 2004360064 | A | 12/2004 |
| JP | 2005307246 | A | 11/2005 |
| JP | 2008291282 | A | 12/2008 |
| JP | 4374196 | B2 | 12/2009 |
| WO | 2012147898 | A1 | 11/2012 |
| WO | 2013038637 | A1 | 3/2013 |
| WO | 2016067623 | A1 | 5/2016 |
| WO | 2016067625 | A1 | 5/2016 |
| WO | 2016067626 | A1 | 5/2016 |

OTHER PUBLICATIONS

Aug. 27, 2019, the Extended European Search Report issued by the European Patent Office in the corresponding European Patent Application No. 17870782.4.

* cited by examiner

HIGH-STRENGTH STEEL SHEET AND METHOD FOR PRODUCING SAME

TECHNICAL FIELD

This disclosure relates to a high-strength steel sheet with excellent ductility and stretch flangeability (hole expansion formability) and a low yield ratio that is suitable as a part to be used in industrial fields such as automobiles and electronics, as well as a method for producing the same.

BACKGROUND

In recent years, improving the fuel efficiency of automobile has become an important issue from the perspective of global environment protection. Consequently, there is an active movement to increase the strength of automotive body materials to reduce the thickness of automotive body components, thereby reducing the weight of the automotive body itself.

However, strengthening a steel sheet usually deteriorates the ductility and stretch flangeability (hole expansion formability). Therefore, when the strength of a steel sheet increases, the formability of the steel sheet decreases, and problems such as cracking during forming arise. Thus, reducing the thickness of a steel sheet cannot be simply achieved. It has been desired to develop a material with both high strength and excellent formability (ductility and hole expansion formability). Additionally, a steel sheet with a tensile strength (TS) of 590 MPa or more is desired to have high dimensional accuracy on assembly because the steel sheet is subjected to press working, then assembled by, for example, arc welding or spot welding, and combined into modules in an automobile producing process.

Therefore, in addition to excellent ductility and hole expansion formability, such a steel sheet is also required to have low occurrence of, for example, springback after subjection to working. Thus, it is important to have a low yield ratio (YR) before subjection to working.

For example, JP S61-157625 A (PTL 1) proposes a steel sheet with a tensile strength of 1000 MPa or more, a total elongation (EL) of 30% or more, and extremely high ductility obtained by utilizing deformation induced transformation of retained austenite.

Additionally, JP H01-259120 A (PTL 2) proposes a steel sheet that achieves good balance between strength and ductility by using high-Mn steel and performing heat treatment in a ferrite-austenite dual phase region.

Furthermore, J P 2003-138345 A (PTL 3) proposes a steel sheet, where high-Mn steel is made to have a microstructure containing bainite and martensite after hot rolling, then subjected to annealing and tempering to form fine retained austenite, and then made to have a microstructure containing tempered bainite or tempered martensite, to improve the local ductility of the steel sheet.

CITATION LIST

Patent Literature

PTL 1: JP S61-157625 A
PTL 2: JP H01-259120 A
PTL 3: JP 2003-138345 A

SUMMARY

Technical Problem

The steel sheet described in PTL 1 is produced by austenitizing a steel sheet containing C, Si and Mn as basic components, and then subjecting the steel sheet to a so-called austempering treatment where the steel sheet is quenched to and held isothermally in a bainite transformation temperature range. During the austempering treatment, C concentrates in austenite to form retained austenite.

However, a high concentration of C above 0.3 mass % is required for the formation of a large amount of retained austenite, and such a high concentration of C above 0.3 mass % leads to a significant decrease in spot weldability, which may not be suitable for practical use in steel sheets for automobiles.

Additionally, the main objective of PTL 1 is to improve the ductility of a steel sheet, so that PTL 1 does not take the hole expansion formability or yield ratio into consideration.

Furthermore, although PTLs 2 and 3 describe how to improve the ductility of a steel sheet, they do not take the yield ratio into consideration.

It could thus be helpful to provide a high-strength steel sheet with excellent ductility and hole expansion formability and a low yield ratio, specifically a high-strength steel sheet with a yield ratio (YR) of less than 68% and a tensile strength (TS) of 590 MPa or more, as well as an advantageous method for producing the same.

As used herein, the 'high-strength steel sheet' includes a high-strength steel sheet with a hot-dip galvanized layer on the surface (a high-strength hot-dip galvanized steel sheet), a high-strength steel sheet with a hot-dip aluminum-coated layer on the surface (a high-strength hot-dip aluminum-coated steel sheet) and a high-strength steel sheet with an electrogalvanized layer on the surface (a high-strength electrogalvanized steel sheet).

Solution to Problem

We made intensive studies on the development of high-strength steel sheet with excellent formability (ductility and hole expansion formability) and a low yield ratio, and discovered the following.

(1) In order to obtain a high-strength steel sheet that exhibits excellent ductility and hole expansion formability and has a YR of less than 68% and a TS of 590 MPa or more, the following factors are important.

- The Mn content should be 2.60 mass % or more and 4.20 mass % or less, and the other components should be adjusted to predetermined ranges.
- The steel microstructure should contain ferrite, martensite and retained austenite in appropriate amounts, and these constituent phases should be refined.
- The rolling reduction of cold rolling should be set to 3% or more and less than 30%, so that the average aspect ratio of crystal grain of each of the ferrite, the martensite and the retained austenite could be adjusted to more than 2.0 and 15.0 or less.
- A value obtained by dividing the Mn content (mass %) in retained austenite by the Mn content (mass %) in ferrite should be appropriately adjusted.

(2) Additionally, in order to obtain the microstructure as described above, it is important to adjust the contents of the chemical composition components to predetermined ranges, and to appropriately control the producing conditions, particularly the conditions of post-hot-rolling heat treatment (hot band annealing) and the conditions of post-cold-rolling heat treatment (cold-rolled sheet annealing).

The present disclosure is based on these discoveries and further studies.

We provide the following.

1. A high-strength steel sheet comprising:

a chemical composition consisting of, by mass %,

C: 0.030% or more and 0.250% or less,

Si: 0.01% or more and 3.00% or less,

Mn: 2.60% or more and 4.20% or less,

P: 0.001% or more and 0.100% or less,

S: 0.0001% or more and 0.0200% or less,

N: 0.0005% or more and 0.0100% or less, and

Ti: 0.003% or more and 0.200% or less, the balance being Fe and inevitable impurities, and a microstructure where ferrite is 35% or more and 80% or less in area ratio, martensite is 5% or more and 25% or less in area ratio, and retained austenite is 8% or more in volume fraction, wherein an average grain size of the ferrite is 6.0 μm or less, an average grain size of the martensite is 3.0 μm or less, an average grain size of the retained austenite is 3.0 μm or less, an average aspect ratio of crystal grain of each of the ferrite, the martensite and the retained austenite is more than 2.0 and 15.0 or less, a value obtained by dividing a Mn content (mass %) in the retained austenite by a Mn content (mass %) in the ferrite is 2.0 or more, and the high-strength steel sheet has a tensile strength of 590 MPa or more and a yield ratio of less than 68%.

2. The high-strength steel sheet according to 1., wherein the chemical composition further contains, by mass %, Al: 0.01% or more and 2.00% or less.

3. The high-strength steel sheet according to 1. or 2., wherein the chemical composition further contains, by mass %, at least one element selected from Nb: 0.005% or more and 0.200% or less, B: 0.0003% or more and 0.0050% or less, Ni: 0.005% or more and 1.000% or less, Cr: 0.005% or more and 1.000% or less, V: 0.005% or more and 0.500% or less, Mo: 0.005% or more and 1.000% or less, Cu: 0.005% or more and 1.000% or less, Sn: 0.002% or more and 0.200% or less, Sb: 0.002% or more and 0.200% or less, Ta: 0.001% or more and 0.010% or less, Ca: 0.0005% or more and 0.0050% or less, Mg: 0.0005% or more and 0.0050% or less, or REM: 0.0005% or more and 0.0050% or less.

4. The high-strength steel sheet according to any one of 1. to 3., comprising a hot-dip galvanized layer on a surface.

5. The high-strength steel sheet according to any one of 1. to 3., comprising a hot-dip aluminum-coated layer on a surface.

6. The high-strength steel sheet according to any one of 1. to 3., comprising an electrogalvanized layer on a surface.

7. A method for producing the high-strength steel sheet according to any one of 1. to 3., comprising:

subjecting a steel slab having the chemical composition according to any one of 1. to 3. to hot rolling, in which the steel slab is heated to 1100° C. or higher and 1300° C. or lower, hot rolled with a finisher delivery temperature of 750° C. or higher and 1000° C. or lower, and coiled at an average coiling temperature of 300° C. or higher and 750° C. or lower to obtain a hot-rolled sheet;

subjecting the hot-rolled sheet to pickling, in which scales are removed;

subjecting the hot-rolled sheet to hot band annealing, in which the hot-rolled sheet is held in a temperature range of ($Ac_1$ transformation point+20° C.) or higher and ($Ac_1$ transformation point+120° C.) or lower for 600 seconds or more and 21600 seconds or less;

subjecting the hot-rolled sheet to cold rolling, in which the hot-rolled sheet is cold rolled with a rolling reduction of 3% or more and less than 30% to obtain a cold-rolled sheet; and subjecting the cold-rolled sheet to cold-rolled sheet annealing, in which the cold-rolled sheet is held in a temperature range of ($Ac_1$ transformation point+10° C.) or higher and ($Ac_1$ transformation point+100° C.) or lower for more than 900 seconds and 21600 seconds or less and then cooled.

8. A method for producing the high-strength steel sheet according to 4., wherein after the cold-rolled sheet annealing according to 7., the cold-rolled sheet is further subjected to hot-dip galvanizing treatment, or after the cold-rolled sheet annealing according to 7., the cold-rolled sheet is further subjected to hot-dip galvanizing treatment, and then to alloying treatment in a temperature range of 450° C. or higher and 600° C. or lower.

9. A method for producing the high-strength steel sheet according to 5., wherein after the cold-rolled sheet annealing according to 7., the cold-rolled sheet is further subjected to hot-dip aluminum-coating treatment.

10. A method for producing the high-strength steel sheet according to 6., wherein after the cold-rolled sheet annealing according to 7., the cold-rolled sheet is further subjected to electrogalvanizing treatment.

Advantageous Effect

According to the present disclosure, it is possible to obtain a high-strength steel sheet that exhibits excellent ductility and hole expansion formability and has a yield ratio (YR) of less than 68% and a tensile strength (TS) of 590 MPa or more.

The high-strength steel sheet of the present disclosure is highly beneficial in industrial terms, because it can reduce the automotive body weight and thereby improve the fuel efficiency when applied to, for example, an automobile structural part.

DETAILED DESCRIPTION

The following describes the present disclosure in detail. First, the chemical composition of the high-strength steel sheet of the present disclosure will be described.

In the description of the chemical composition, '%' denotes 'mass %' unless otherwise noted.

C: 0.030% or More and 0.250% or Less

C is an element necessary for causing the formation of a low-temperature transformation phase such as martensite to increase the strength. C is also a useful element for increasing the stability of retained austenite to increase the ductility of the steel.

If the C content is less than 0.030%, it is difficult to ensure a desired amount of martensite, so that desired strength cannot be obtained. It is also difficult to ensure a sufficient amount of retained austenite, so that good ductility cannot be obtained. On the other hand, if C is excessively added to an amount of more than 0.250%, the amount of hard martensite excessively increases, which causes more microvoids at grain boundaries of martensite. As a result, the propagation of cracks during a hole expanding test is facilitated, and the stretch flangeability (hole expansion formability) is decreased. Moreover, the welds and heat-affected zone (HAZ) harden significantly and the mechanical properties of the welds decrease, leading to deterioration in, for example, spot weldability and arc weldability.

Thus, the C content is set to 0.030% or more and 0.250% or less. The C content is preferably 0.080% or more and 0.200% or less.

Si: 0.01% or More and 3.00% or Less

Si improves the strain hardenability of ferrite, and therefore is a useful element for ensuring good ductility. However, if the Si content is less than 0.01%, the addition effect is limited. Therefore, the lower limit is set to 0.01%. On the other hand, excessively adding Si to an amount of more than 3.00% not only causes decrease in ductility and hole expansion formability due to the embrittlement of the steel, but also causes deterioration in surface characteristics due to occurrence of, for example, red scales. Thus, the Si content is set to 0.01% or more and 3.00% or less. The Si content is preferably 0.20% or more and 2.00% or less.

Mn: 2.60% or More and 4.20% or Less

Mn is a very important element for the present disclosure. Specifically, Mn is an element that stabilizes retained austenite to effectively ensure good ductility, and is also an element that increases the strength of the steel through solid solution strengthening. The effect can be obtained when the Mn content in the steel is 2.60% or more. On the other hand, if Mn is added to an amount of more than 4.20%, the costs increase. Thus, the Mn content is set to 2.60% or more and 4.20% or less. The Mn content is preferably 3.00% or more.

P: 0.001% or More and 0.100% or Less

P has a solid solution strengthening effect and can be added depending on the desired strength. P also facilitates ferrite transformation, and is therefore a useful element for forming a multi-phase structure in the steel sheet. In order to obtain the effect, the P content should be 0.001% or more. On the other hand, if the P content is more than 0.100%, the spot weldability is remarkably deteriorated. Additionally, in that case, when a hot-dip galvanized layer is subjected to alloying treatment, the alloying speed is lowered and the quality of the galvannealed layer is impaired. Thus, the P content is set to 0.001% or more and 0.100% or less. The P content is preferably 0.001% or more and 0.050% or less.

S: 0.0001% or More and 0.0200% or Less

S not only segregates to grain boundaries to embrittle the steel during hot working, but also forms sulfides to decrease the local deformability of the steel sheet. Additionally, if the S content is more than 0.0200%, the spot weldability is remarkably deteriorated. Therefore, the S content should be 0.0200% or less. The S content is preferably 0.0100% or less. The S content is more preferably 0.0050% or less. Under production constraints, however, the S content is set to 0.0001% or more. Thus, the S content is set to 0.0001% or more and 0.0200% or less. The S content is preferably 0.0001% or more and 0.0100% or less. The S content is more preferably 0.0001% or more and 0.0050% or less.

N: 0.0005% or More and 0.0100% or Less

N is an element that deteriorates the anti-aging property of the steel. Particularly, when the N content is more than 0.0100%, the anti-aging property is remarkably deteriorated. A smaller N content is more preferable. Under production constraints, however, the N content is set to 0.0005% or more. Thus, the N content is set to 0.0005% or more and 0.0100% or less. The N content is preferably 0.0010% or more and 0.0070% or less.

Ti: 0.003% or More and 0.200% or Less

Ti is a very important element for the present disclosure. Specifically, Ti is a useful element for achieving strengthening by crystal grain refinement and strengthening by precipitation of the steel, and this effect can be obtained when the Ti content is 0.003% or more. Additionally, Ti improves the ductility at high temperature, and effectively contributes to the improvement of castability during continuous casting. However, if the Ti content is more than 0.200%, the amount of hard martensite excessively increases, which causes more microvoids at grain boundaries of martensite. As a result, the propagation of cracks during a hole expanding test is facilitated, and the hole expansion formability is decreased. Thus, the Ti content is set to 0.003% or more and 0.200% or less. The Ti content is preferably 0.010% or more and 0.100% or less.

The steel sheet of the present disclosure can also contain Al in the following range in addition to the above components.

Al: 0.01% or More and 2.00% or Less

Al is a useful element for increasing the area of a ferrite-austenite dual phase region and reducing the annealing temperature dependency, i.e., increasing the stability of the steel sheet as a material. Additionally, Al acts as a deoxidizer and is useful for the cleanliness of the steel. If the Al content is less than 0.01%, however, the addition effect is limited. Therefore, the lower limit is set to 0.01%. On the other hand, when Al is excessively added to an amount of more than 2.00%, the risk of occurrence of cracking in a semi-finished product during continuous casting increases, and the manufacturability decreases. Thus, when added to the steel, the Al content is set to 0.01% or more and 2.00% or less. The Al content is preferably 0.20% or more and 1.20% or less.

Furthermore, the steel sheet of the present disclosure can contain at least one element selected from Nb, B, Ni, Cr, V, Mo, Cu, Sn, Sb, Ta, Ca, Mg or REM, in addition to the above components.

Nb: 0.005% or More and 0.200% or Less

Nb is useful for achieving strengthening by precipitation of the steel. The addition effect can be obtained when the content is 0.005% or more. However, if the Nb content is more than 0.200%, the amount of hard martensite excessively increases, which causes more microvoids at grain boundaries of martensite. As a result, the propagation of cracks during a hole expanding test is facilitated, the hole expansion formability is decreased, and the costs are increased. Thus, when added to the steel, the Nb content is set to 0.005% or more and 0.200% or less. The Nb content is preferably 0.010% or more and 0.100% or less.

B: 0.0003% or More and 0.0050% or Less

B may be added as necessary, because it has the effect of suppressing the generation and growth of ferrite from austenite grain boundaries and enables microstructure control according to the circumstances. The addition effect can be obtained when the B content is 0.0003% or more. If the B content is more than 0.0050%, however, the formability decreases. Thus, when added to the steel, the B content is set to 0.0003% or more and 0.0050% or less. The B content is preferably 0.0005% or more and 0.0030% or less.

Ni: 0.005% or More and 1.000% or Less

Ni is an element that stabilizes retained austenite to effectively ensure good ductility, and is also an element that increases the strength of the steel through solid solution strengthening. The addition effect can be obtained when the Ni content is 0.005% or more. On the other hand, if the Ni content is more than 1.000%, the amount of hard martensite excessively increases, which causes more microvoids at grain boundaries of martensite. As a result, the propagation of cracks during a hole expanding test is facilitated, the hole expansion formability is decreased, and the costs are increased. Thus, when added to the steel, the Ni content is set to 0.005% or more and 1.000% or less.

Cr: 0.005% or More and 1.000% or Less, V: 0.005% or More and 0.500% or Less, and Mo: 0.005% or More and 1.000% or Less Cr, V, and Mo are elements that may be added as necessary, because they all have the effect of improving the balance between strength and ductility. The addition effect can be obtained when the Cr content is 0.005% or more, the V content is 0.005% or more and the Mo content is 0.005% or more. However, if more than 1.000% of Cr, more than 0.500% of V and more than 1.000% of Mo are excessively added to the steel respectively, the amount of hard martensite excessively increases, which causes more microvoids at grain boundaries of martensite. As a result, the propagation of cracks during a hole expanding test is facilitated, the hole expansion formability is decreased, and the costs are increased. Thus, when added to the steel, the Cr content is set to 0.005% or more and 1.000% or less, the V content is set to 0.005% or more and 0.500% or less, and the Mo content is set to 0.005% or more and 1.000% or less, respectively.

Cu: 0.005% or More and 1.000% or Less

Cu is a useful element for strengthening the steel. The addition effect can be obtained when the content is 0.005% or more. On the other hand, if the Cu content is more than 1.000%, the amount of hard martensite excessively increases, which causes more microvoids at grain boundaries of martensite. As a result, the propagation of cracks during a hole expanding test is facilitated, and the hole expansion formability is decreased. Thus, when added to the steel, the Cu content is set to 0.005% or more and 1.000% or less.

Sn: 0.002% or More and 0.200% or Less, and Sb: 0.002% or More and 0.200% or Less Both Sn and Sb are elements that may be added as necessary from the perspective of suppressing the decarbonization of a region extending from the surface layer of the steel sheet to a depth of about several tens of micrometers, which is resulted from the nitriding or oxidation of the steel sheet surface. Suppressing the nitriding and oxidation in this way may prevent a reduction in the martensite amount in the steel sheet surface. Therefore, Sn and Sb are useful for ensuring the strength of the steel sheet and the stability of the steel sheet as a material. However, if Sn and Sb are both excessively added to an amount of more than 0.200%, the toughness decreases. Thus, when added to the steel, the content of both of Sn and Sb is set to 0.002% or more and 0.200% or less.

Ta: 0.001% or More and 0.010% or Less

Ta forms alloy carbides or alloy carbonitrides, and contributes to increasing the strength of the steel, as is the case with Ti and Nb. It is also believed that when Ta is partially dissolved in Nb carbides or Nb carbonitrides to form complex precipitates such as (Nb, Ta) (C, N), it has the effect of suppressing the coarsening of precipitates and stabilizing the contribution to strength improvement through strengthening by precipitation. Therefore, Ta is preferably added to the steel. The above-described precipitate stabilizing effect can be obtained when the Ta content is 0.001% or more. Excessively adding Ta, however, fails to increase the addition effect, but instead results in a rise in alloying costs. Thus, when added to the steel, the Ta content is set to 0.001% or more and 0.010% or less.

Ca: 0.0005% or More and 0.0050% or Less, Mg: 0.0005% or More and 0.0050% or Less, and REM: 0.0005% or More and 0.0050% or Less Ca, Mg and REM are all useful elements for causing the spheroidization of sulfides and mitigating the adverse effect of sulfides on the hole expansion formability (stretch flangeability). In order to obtain the effect, it is necessary to add each of these elements to an amount of 0.0005% or more. However, if each of Ca, Mg and REM is excessively added to an amount of more than 0.0050%, the number of inclusions, for example, increase, and defects such as surface defects and internal defects are caused in the steel sheet. Thus, when Ca, Mg and REM are added to the steel, the content of each element is set to 0.0005% or more and 0.0050% or less.

The balance other than the above components consists of Fe and inevitable impurities.

The following provides a description of the microstructure of the high-strength steel sheet of the present disclosure.

Area Ratio of Ferrite: 35% or More and 80% or Less

In order to ensure sufficient ductility, the high-strength steel sheet of the present disclosure needs to have an amount of ferrite of 35% or more in area ratio. On the other hand, in order to ensure a TS of 590 MPa or more, the amount of soft ferrite should be 80% or less in area ratio. The amount of ferrite is preferably 40% or more and 75% or less in area ratio.

Area Ratio of Martensite: 5% or More and 25% or Less

In order to achieve a TS of 590 MPa or more, the amount of martensite should be 5% or more in area ratio. On the other hand, in order to ensure good ductility, the amount of martensite should be 25% or less in area ratio. The amount of martensite is preferably 8% or more and 20% or less in area ratio.

The area ratios of ferrite and martensite can be determined in the following way.

Specifically, a steel sheet cross section taken in the sheet thickness direction to be parallel to the rolling direction (which is an L-cross section) is polished and then etched with 3 vol. % nital. Ten locations, each in a range of 60 μm×45 μm, are observed at 2000 times magnification under a scanning electron microscope (SEM) at a position of sheet thickness×¼ (which is the position at a depth of one-fourth of the sheet thickness from the steel sheet surface), to capture microstructure micrographs. The captured microstructure micrographs are used to calculate the area ratio of each phase (ferrite and martensite) for the ten locations, using Image-Pro manufactured by Media Cybernetics. Then, each average is determined as the area ratio of the corresponding phase. In the microstructure micrographs, ferrite appears as a gray structure (base steel structure) and martensite appears as a white structure. Ferrite and martensite are identified in this way.

Volume Fraction of Retained Austenite: 8% or More

In order to ensure sufficient ductility, the high-strength steel sheet of the present disclosure needs to have an amount of retained austenite of 8% or more in volume fraction. The amount of retained austenite is preferably 10% or more in volume fraction. The upper limit of the volume fraction of retained austenite is not particularly restricted. However, a preferred upper limit is around 60%, considering that an increase in volume fraction of retained austenite may lead to formation of more retained austenite that is less effective in improving ductility, i.e., so-called unstable retained austenite resulting from insufficient concentration of components such as C and Mn. A more preferred upper limit is 50% or less.

The volume fraction of retained austenite is determined by measuring the X-ray diffraction intensity of a plane of sheet thickness×¼ (a plane at a depth of one-fourth of the sheet thickness from the steel sheet surface), which is exposed by polishing the steel sheet surface to a depth of one-fourth of the sheet thickness. Using an incident X-ray beam of MoKα, the intensity ratio of the peak integrated intensity of the {111}, {200}, {220} and {311} planes of retained austenite to the peak integrated intensity of the {HO}, {200} and {211} planes of ferrite is calculated for all of the twelve combinations. The results are averaged, and the average is used as the volume fraction of retained austenite.

Average Grain Size of Ferrite: 6.0 μm or Less

Refinement of crystal grains of ferrite contributes to the improvement of tensile strength (TS) and stretch flangeability (hole expansion formability). In order to ensure a desired TS and high hole expansion formability, the average grain size of ferrite should be 6.0 μm or less. The average grain size of ferrite is preferably 5.0 μm or less.

The lower limit of the average grain size of ferrite is not particularly restricted. However, a preferred lower limit is around 0.3 μm from an industrial perspective.

Average Grain Size of Martensite: 3.0 μm or Less

Refinement of crystal grains of martensite contributes to the improvement of hole expansion formability. In order to ensure high stretch flangeability (high hole expansion formability), the average grain size of martensite should be 3.0 μm or less. The average grain size of martensite is preferably 2.5 μm or less.

The lower limit of the average grain size of martensite is not particularly restricted. However, a preferred lower limit is around 0.1 μm from an industrial perspective.

Average Grain Size of Retained Austenite: 3.0 μm or Less

Refinement of crystal grains of retained austenite contributes to the improvement of ductility and hole expansion formability. In order to ensure good ductility and hole expansion formability, the average grain size of retained austenite should be 3.0 μm or less. The average grain size of retained austenite is preferably 2.5 μm or less.

The lower limit of the average grain size of retained austenite is not particularly restricted. However, a preferred lower limit is around 0.1 μm from an industrial perspective.

The average grain size of each of ferrite, martensite and retained austenite is determined by measuring the area ratio of ferrite grains, martensite grains and retained austenite grains respectively in the microstructure micrographs obtained in a similar manner to that used for the area ratios using Image-Pro as described above, calculating the equivalent circular diameter, and averaging the results. Martensite and retained austenite are identified using an electron backscatter diffraction (EBSD) phase map.

In this case, each of the above-described average grain sizes is determined by a measurement for crystal grains with a grain size of 0.01 μm or more.

Average Aspect Ratio of Crystal Grain of Each of Ferrite, Martensite and Retained Austenite: More than 2.0 and 15.0 or Less It is very important for the present disclosure that the average aspect ratio of crystal grain of each of ferrite, martensite and retained austenite is more than 2.0 and 15.0 or less.

Specifically, the fact that the aspect ratio of crystal grain is large means that the grains have grown with recovery and with almost no recrystallization and elongated fine crystal grains have formed during the temperature increasing and holding in the post-cold-rolling heat treatment (cold-rolled sheet annealing). For a structure composed of such fine crystal grains with a high aspect ratio, microvoids are hardly caused during the blanking before a hole expanding test and during the hole expanding test, which greatly contributes to the improvement of hole expansion formability. Furthermore, ferrite with a large average aspect ratio has an influence on deformation even if it is fine. In this way, the elongation at yield point can be suppressed, and the stretcher strain (a defect where a strain pattern appears in stripes when a material that elongates largely at yield point undergoes plastic deformation) after press forming can be suppressed. However, when the aspect ratio is more than 15.0, the anisotropy of the material properties may increase.

Thus, the average aspect ratio of crystal grain of each of ferrite, martensite and retained austenite is set to more than 2.0 and 15.0 or less.

The average aspect ratio of crystal grain of each of ferrite, martensite and retained austenite is preferably 2.2 or more. The average aspect ratio of crystal grain of each of ferrite, martensite and retained austenite is more preferably 2.4 or more.

As used herein, the 'aspect ratio of crystal grain' refers to a value obtained by dividing the major axis length of the crystal grain by the minor axis length of the crystal grain. The average aspect ratio of crystal grain of each phase can be determined in the following way.

Specifically, the average aspect ratio of crystal grain of each of ferrite, martensite and retained austenite can be determined by obtaining microstructure micrographs in a similar manner to that used for the area ratios using Image-Pro as described above; observing the ferrite grains, martensite grains and retained austenite grains in the microstructure micrographs, where 30 crystal grains are observed for each phase, to obtain the major axis length and minor axis length of each crystal grain; dividing the major axis length by the minor axis length for each crystal grain; and averaging the results to obtain the average aspect ratio.

A Value Obtained by Dividing the Mn Content (Mass %) in Retained Austenite by the Mn Content (Mass %) in Ferrite: 2.0 or More It is very important for the present disclosure that a value obtained by dividing the Mn content in retained austenite by the Mn content (mass %) in ferrite is 2.0 or more. The reason is that in order to ensure good ductility, it is necessary to have a large amount of stable retained austenite with concentrated Mn.

The upper limit of the value obtained by dividing the Mn content (mass %) in retained austenite by the Mn content (mass %) in ferrite is not particularly restricted. However, a preferred upper limit is around 16.0 from the perspective of stretch flangeability.

The Mn contents in retained austenite and ferrite can be determined in the following way.

Specifically, an electron probe micro analyzer (EPMA) is used to quantify the distribution of Mn in each phase in a cross section along the rolling direction at a position of sheet thickness×¼. Subsequently, 30 retained austenite grains and 30 ferrite grains are each analyzed to determine the Mn content. The Mn contents of the retained austenite grains and the Mn contents of the ferrite grains obtained from the analysis results are averaged respectively, and each average is used as the Mn content in the corresponding phase.

The microstructure of the high-strength steel sheet of the present disclosure may contain carbides (excluding cementite in pearlite) such as bainitic ferrite, tempered martensite, pearlite and cementite, in addition to ferrite, martensite and retained austenite. Any of these structures may be contained as long as the total area ratio is 10% or less, without impairing the effect of the present disclosure.

The following describes a method for producing the high-strength steel sheet of the present disclosure.

The method for producing the high-strength steel sheet of the present disclosure includes subjecting a steel slab having the above-described chemical composition to hot rolling, in which the steel slab is heated to 1100° C. or higher and 1300° C. or lower, hot rolled with a finisher delivery temperature of 750° C. or higher and 1000° C. or lower, and coiled at an average coiling temperature of 300° C. or higher and 750° C. or lower to obtain a hot-rolled sheet; subjecting the hot-rolled sheet to pickling, in which scales are removed; subjecting the hot-rolled sheet to hot band annealing, in which the hot-rolled sheet is held in a temperature range of ($Ac_1$ transformation point+20° C.) or higher and ($Ac_1$ transformation point+120° C.) or lower for 600 seconds or more and 21600 seconds or less; subjecting the hot-rolled sheet to cold rolling, in which the hot-rolled sheet is cold rolled with a rolling reduction of 3% or more and less than 30% to obtain a cold-rolled sheet; and subjecting the cold-rolled sheet to cold-rolled sheet annealing, in which the cold-rolled sheet is held in a temperature range of ($Ac_1$ transformation point+10° C.) or higher and ($Ac_1$ transformation point+100° C.) or lower for more than 900 seconds and 21600 seconds or less and then cooled.

The following explains the reasons for the limitations placed on the producing conditions.

Steel Slab Heating Temperature: 1100° C. or Higher and 1300° C. or Lower

Precipitates present in the steel slab at the time of heating remain as coarse precipitates in a final steel sheet, which makes no contribution to the strength. Therefore, it is necessary to remelt Ti- and Nb-based precipitates that are precipitated during casting.

When the steel slab heating temperature is lower than 1100° C., it is difficult to melt carbides sufficiently, and problems arise such as an increased risk of occurrence of trouble during hot rolling due to an increased rolling load. Therefore, the steel slab heating temperature should be 1100° C. or higher.

Additionally, from the perspective of obtaining a smooth steel sheet surface by scaling-off the defects such as blow hole and segregation in the slab surface layer and reducing cracks and irregularities over the steel sheet surface, the steel slab heating temperature should be 1100° C. or higher.

On the other hand, if the steel slab heating temperature is higher than 1300° C., scale loss increases as oxidation progresses. Therefore, the steel slab heating temperature should be 1300° C. or lower.

Thus, the steel slab heating temperature is set to 1100° C. or higher and 1300° C. or lower. The steel slab heating temperature is preferably 1150° C. or higher and 1250° C. or lower.

The steel slab is preferably produced with continuous casting from the perspective of preventing macro segregation. However, it is also acceptable to produce the steel slab with other methods such as ingot casting or thin slab casting. After the steel slab is produced, a conventional method may be used where the steel slab is cooled to room temperature and then heated again. Alternatively, after the steel slab is produced, energy-saving processes may be applied without any problem, such as hot direct rolling or direct rolling where the steel slab is either charged into a heating furnace as a warm steel slab without being fully cooled to room temperature, or subjected to rolling immediately after a short period of heat retention. Furthermore, the steel slab is subjected to rough rolling under normal conditions and formed into a sheet bar. When the heating temperature is low, the sheet bar is preferably heated with, for example, a bar heater before subjection to finish rolling, from the perspective of preventing occurrence of trouble during hot rolling.

Finisher Delivery Temperature of Hot Rolling: 750° C. or Higher and 1000° C. or Lower The heated steel slab is subjected to rough rolling and finish rolling to be hot rolled into a hot-rolled steel sheet. In this case, if the finisher delivery temperature is higher than 1000° C., the amount of oxides (scales) generated suddenly increases and the interface between the steel substrate and oxides becomes rough, which tends to impair the surface quality of the steel sheet after subjection to pickling and cold rolling. Additionally, any hot-rolling scale remaining after pickling adversely affects the ductility and stretch flangeability. Furthermore, there is a possibility that the grain size excessively increases and the surface of a pressed part becomes rough during working.

On the other hand, if the finisher delivery temperature is lower than 750° C., the rolling load increases, leading to an increase in rolling burden or an increase in rolling reduction with austenite in a non-recrystallized state. As a result, an abnormal texture develops in the steel sheet and planar anisotropy becomes pronounced in a final product, which not only impairs the uniformity of material properties but also decreases the ductility itself. Thus, the finisher delivery temperature of hot rolling should be 750° C. or higher and 1000° C. or lower. The finisher delivery temperature is preferably 800° C. or higher and 950° C. or lower.

Average Coiling Temperature after Hot Rolling: 300° C. or Higher and 750° C. or Lower The average coiling temperature is the average value of the coiling temperature of a hot rolled coil overall. If the average coiling temperature after hot rolling is higher than 750° C., the grain size of ferrite in the microstructure of the hot-rolled sheet increases, and it is difficult to ensure desired strength. On the other hand, if the average coiling temperature after hot rolling is lower than 300° C., the strength of the hot-rolled sheet increases, and the rolling load during cold rolling increases and the steel sheet suffers malformation. As a result, the productivity decreases. Thus, the average coiling temperature after hot rolling should be 300° C. or higher and 750° C. or lower. The average coiling temperature is preferably 400° C. or higher and 650° C. or lower.

Finish rolling may be performed continuously by joining the rough-rolled sheets during the hot rolling. The rough-rolled sheets may be coiled on a temporary basis. At least part of the finish rolling may be performed as lubrication rolling in order to reduce the rolling load during hot rolling. Performing lubrication rolling is effective from the perspective of making the shape and material properties of the steel sheet uniform. The coefficient of friction during the lubrication rolling is preferably 0.10 or more and 0.25 or less.

The hot-rolled steel sheet thus obtained is subjected to pickling. Pickling can remove oxides (scales) from the steel sheet surface. Therefore, pickling is important for ensuring that the high-strength steel sheet as a final product has good chemical convertibility and coating or plating quality. The pickling may be performed in one or more batches.

Hot Band Annealing (Heat Treatment) Conditions: Holding in a Temperature Range of ($Ac_1$ Transformation Point+

20° C.) or Higher and ($Ac_1$ Transformation Point+120° C.) or Lower for 600 Seconds or More and 21600 Seconds or Less It is very important for the present disclosure to hold the steel sheet in a temperature range of ($Ac_1$ transformation point+20° C.) or higher and ($Ac_1$ transformation point+120° C.) or lower for 600 seconds or more and 21600 seconds or less during the hot band annealing.

Specifically, in a case where the annealing temperature (holding temperature) of hot band annealing is lower than ($Ac_1$ transformation point+20° C.) or higher than ($Ac_1$ transformation point+120° C.), or in a case where the holding time is less than 600 seconds, concentration of Mn in austenite does not proceed, a sufficient amount of retained austenite cannot be ensured after the final annealing (cold-rolled sheet annealing), and the ductility decreases. On the other hand, if the holding time is more than 21600 seconds, concentration of Mn in austenite reaches a plateau, the effect of improving the ductility of the steel sheet obtained after the final annealing reduces, and the costs increase.

Thus, the steel sheet is held in a temperature range of ($Ac_1$ transformation point+20° C.) or higher and ($Ac_1$ transformation point+120° C.) or lower for 600 seconds or more and 21600 seconds or less during the hot band annealing. The temperature range is preferably ($Ac_1$ transformation point+30° C.) or higher and ($Ac_1$ transformation point+100° C.) or lower. The holding time is preferably 1000 seconds or more and 18000 seconds or less.

The heat treatment method may be a continuous annealing method or a batch annealing method. After the above-described heat treatment, the steel sheet is cooled to room temperature. The cooling method and cooling rate are not particularly restricted, and any type of cooling may be performed, including furnace cooling and air cooling in batch annealing, and gas jet cooling, mist cooling and water cooling in continuous annealing. The pickling may be performed according to a conventional method.

Rolling Reduction in Cold Rolling: 3% or More and Less than 30%

The rolling reduction in cold rolling is set to 3% or more and less than 30%. When the cold rolling is performed with a rolling reduction of 3% or more and less than 30%, ferrite and austenite grains grow with recovery and with almost no recrystallization, and elongated fine crystal grains form during the temperature increasing and holding in the post-cold-rolling heat treatment (cold-rolled sheet annealing). Specifically, ferrite, retained austenite and martensite having a high aspect ratio can be obtained, which not only improves the balance between strength and ductility but also remarkably improves the stretch flangeability (hole expansion formability).

Cold-Rolled Sheet Annealing (Heat Treatment) Conditions: Holding in a Temperature Range of ($Ac_1$ Transformation Point+10° C.) or Higher and ($Ac_1$ Transformation Point+100° C.) or Lower for More than 900 Seconds and 21600 Seconds or Less It is very important for the present disclosure to hold the steel sheet in a temperature range of ($Ac_1$ transformation point+10° C.) or higher and ($Ac_1$ transformation point+100° C.) or lower for more than 900 seconds and 21600 seconds or less during the cold-rolled sheet annealing.

Specifically, in a case where the annealing temperature (holding temperature) of cold-rolled sheet annealing is lower than ($Ac_1$ transformation point+10° C.) or higher than ($Ac_1$ transformation point+100° C.), concentration of Mn in austenite does not proceed, a sufficient amount of retained austenite cannot be ensured, and the ductility decreases.

Additionally, in a case where the holding time is 900 seconds or less, reverse transformation does not proceed, a desired amount of retained austenite cannot be ensured, and the ductility decreases. As a result, the yield strength (YP) increases, leading to a higher yield ratio (YR). On the other hand, if the holding time is more than 21600 seconds, concentration of Mn in austenite reaches a plateau, the effect of improving the ductility of the steel sheet obtained after the final annealing (cold-rolled sheet annealing) reduces, and the costs increase.

Thus, the steel sheet is held in a temperature range of ($Ac_1$ transformation point+10° C.) or higher and ($Ac_1$ transformation point+100° C.) or lower for more than 900 seconds and 21600 seconds or less during the cold-rolled sheet annealing. The temperature range is preferably ($Ac_1$ transformation point+20° C.) or higher and ($Ac_1$ transformation point+80° C.) or lower. The holding time is preferably 1200 seconds or more and 18000 seconds or less.

The cold-rolled sheet thus obtained may be subjected to coating or plating treatment, such as hot-dip galvanizing treatment, hot-dip aluminum-coating treatment or electrogalvanizing treatment, to obtain a high-strength steel sheet with a hot-dip galvanized layer, hot-dip aluminum-coated layer or electrogalvanized layer on its surface. As used herein, the 'hot-dip galvanizing' includes galvannealing.

For example, when hot-dip galvanizing treatment is performed, the cold-rolled sheet obtained after the above-described cold-rolled sheet annealing is dipped in a hot-dip galvanizing bath at 440° C. or higher and 500° C. or lower for hot-dip galvanizing treatment, and then the coating weight is adjusted, for example, by gas wiping. A galvanizing bath with an Al content of 0.10 mass % or more and 0.22 mass % or less is preferably used for the hot-dip galvanizing. When a hot-dip galvanized layer is subjected to alloying treatment, the alloying treatment on the hot-dip galvanized layer is performed in a temperature range of 450° C. or higher and 600° C. or lower after the hot-dip galvanizing treatment. If the alloying treatment is performed at a temperature higher than 600° C., there is a possibility that untransformed austenite transforms to pearlite, a desired volume fraction of retained austenite cannot be ensured, and the ductility decreases. On the other hand, if the alloying treatment is performed at a temperature lower than 450° C., the alloying process does not proceed, rendering it difficult to form an alloy layer. Thus, when a galvanized layer is subjected to alloying treatment, the alloying treatment on the hot-dip galvanized layer is preferably performed in a temperature range of 450° C. or higher and 600° C. or lower. The coating weight of the hot-dip galvanized layer or of the galvannealed layer is preferably in a range of 10 $g/m^2$ to 150 $g/m^2$ per side.

The other producing conditions are not particularly restricted. However, the series of treatments including annealing, hot-dip galvanizing, and alloying treatment on hot-dip galvanized layer as described above may preferably be performed in a continuous galvanizing line (CGL), which is a hot-dip galvanizing line, from the perspective of productivity.

When hot-dip aluminum coating treatment is performed, the cold-rolled sheet obtained after the above-described cold-rolled sheet annealing is dipped in an aluminum molten bath at 660° C. to 730° C. for hot-dip aluminum coating treatment, and then the coating weight is adjusted, for example, by gas wiping. For steel compatible with an aluminum molten bath temperature of ($Ac_1$ transformation point+10° C.) or higher and ($Ac_1$ transformation point+100°

C.) or lower, the hot-dip aluminum coating treatment leads to formation of finer and more stable retained austenite, which can further improve the ductility. The coating weight of the hot-dip aluminum coated layer is preferably in a range of 10 g/m$^2$ to 150 g/m$^2$ per side.

Furthermore, it is also possible to perform electrogalvanizing treatment to form an electrogalvanized layer. In this case, the thickness of the plating layer is preferably in a range of 5 μm to 15 μm per side.

The high-strength steel sheet thus obtained may be subjected to skin pass rolling for, for example, shape adjustment or surface roughness adjustment. The rolling reduction of the skin pass rolling is preferably 0.1% or more and 2.0% or less. If the rolling reduction is less than 0.1%, the effect is small and the control is difficult. Therefore, 0.1% is set as the lower limit of the favorable range. On the other hand, if the rolling reduction is more than 2.0%, the productivity significantly decreases. Therefore, 2.0% is set as the upper limit of the favorable range.

The skin pass rolling may be performed on-line or off-line, and may be performed in one or more batches to achieve the targeted rolling reduction. Additionally, the high-strength steel sheet thus obtained may be further subjected to various coating treatments such as resin coating and fat and oil coating.

EXAMPLES

Steels having the chemical compositions as listed in Table 1, each with the balance consisting of Fe and inevitable impurities, were prepared by steelmaking in a converter and formed into steel slabs by continuous casting. The resulting steel slabs were subjected to hot rolling, pickling, and then hot band annealing, followed by cold rolling and subsequent cold-rolled sheet annealing to obtain cold-rolled sheets (CR), while varying the conditions as listed in Table 2. Some were further subjected to hot-dip galvanizing treatment (including hot-dip galvanizing treatment followed by alloying treatment), hot-dip aluminum-coating treatment or electrogalvanizing treatment, to obtain hot-dip galvanized steel sheets (GI), galvannealed steel sheets (GA), hot-dip aluminum-coated steel sheets (Al) or electrogalvanized steel sheets (EG).

A zinc bath containing 0.19 mass % of Al was used as the hot-dip galvanizing bath for GI and a zinc bath containing 0.14 mass % of Al was used as the hot-dip galvanizing bath for GA, and the bath temperature in both cases was 465° C. The alloying temperature of GA was as listed in Table 2. The coating weight was 45 g/m$^2$ per side (in a case of coating on both sides), and the Fe concentration in the coated layer of each GA was 9 mass % or more and 12 mass % or less. The bath temperature of the hot-dip aluminum molten bath for hot-dip aluminum-coated steel sheets was 700° C. The thickness of the plating layer of each EG was 8 μm to 12 μm per side (in a case of plating on both sides).

The $Ac_1$ transformation point (° C.) listed in Table 1 was calculated in the following way.

$Ac_1$ transformation point (° C.)=751−16×(% C)+11×(% Si)−28×(% Mn)−5.5×(% Cu)−16×(% Ni)+13×(% Cr)+3.4×(% Mo) where (% C), (% Si), (% Mn), (% Cu), (% Ni), (% Cr) and (% Mo) each represent the content in steel (mass %) of the element in the parentheses.

TABLE 1

| Steel sample | Chemical composition (mass %) | | | | | | | | | | | | | | | | | | | | | $Ac_1$ transformation point | |
|---|---|---|---|---|---|---|---|---|---|---|---|---|---|---|---|---|---|---|---|---|---|---|---|
| ID | C | Si | Mn | P | S | N | Ti | Al | Nb | B | Ni | Cr | V | Mo | Cu | Sn | Sb | Ta | Ca | Mg | REM | (° C.) | Remarks |
| A | 0.108 | 0.22 | 3.26 | 0.004 | 0.0009 | 0.0039 | 0.024 | — | — | — | — | — | — | — | — | — | — | — | — | — | — | 660 | Conforming steel |
| B | 0.124 | 0.19 | 3.62 | 0.005 | 0.0008 | 0.0038 | 0.044 | — | — | — | — | — | — | — | — | — | — | — | — | — | — | 650 | Conforming steel |
| C | 0.233 | 0.22 | 3.26 | 0.003 | 0.0014 | 0.0032 | 0.051 | — | — | — | — | — | — | — | — | — | — | — | — | — | — | 658 | Conforming steel |
| D | 0.141 | 0.36 | 4.01 | 0.004 | 0.0008 | 0.0041 | 0.037 | — | — | — | — | — | — | — | — | — | — | — | — | — | — | 640 | Conforming steel |
| E | 0.058 | 1.22 | 4.05 | 0.003 | 0.0009 | 0.0052 | 0.051 | — | — | — | — | — | — | — | — | — | — | — | — | — | — | 650 | Conforming steel |
| F | 0.102 | 2.68 | 3.28 | 0.014 | 0.0006 | 0.0035 | 0.014 | — | — | — | — | — | — | — | — | — | — | — | — | — | — | 687 | Conforming steel |
| G | 0.124 | 1.38 | 3.08 | 0.006 | 0.0015 | 0.0032 | 0.017 | — | — | — | — | — | — | — | — | — | — | — | — | — | — | 678 | Conforming steel |
| H | 0.154 | 0.09 | 3.49 | 0.004 | 0.0009 | 0.0043 | 0.051 | — | — | — | — | — | — | — | — | — | — | — | — | — | — | 652 | Conforming steel |
| I | 0.122 | 0.85 | 4.09 | 0.030 | 0.0004 | 0.0038 | 0.037 | — | — | — | — | — | — | — | — | — | — | — | — | — | — | 644 | Conforming steel |
| J | 0.146 | 0.47 | 3.64 | 0.014 | 0.0012 | 0.0044 | 0.049 | — | — | — | — | — | — | — | — | — | — | — | — | — | — | 652 | Conforming steel |
| K | 0.118 | 1.44 | 2.74 | 0.020 | 0.0011 | 0.0051 | 0.028 | — | — | — | — | — | — | — | — | — | — | — | — | — | — | 688 | Conforming steel |
| L | 0.013 | 0.89 | 3.85 | 0.024 | 0.0022 | 0.0041 | 0.036 | — | — | — | — | — | — | — | — | — | — | — | — | — | — | 653 | Comparative steel |
| M | 0.356 | 0.16 | 3.09 | 0.028 | 0.0011 | 0.0036 | 0.022 | — | — | — | — | — | — | — | — | — | — | — | — | — | — | 661 | Comparative steel |
| N | 0.134 | 3.72 | 3.78 | 0.017 | 0.0018 | 0.0039 | 0.018 | — | — | — | — | — | — | — | — | — | — | — | — | — | — | 684 | Comparative steel |
| O | 0.210 | 1.48 | 2.18 | 0.025 | 0.0021 | 0.0033 | 0.064 | — | — | — | — | — | — | — | — | — | — | — | — | — | — | 703 | Comparative steel |
| P | 0.182 | 1.03 | 3.95 | 0.029 | 0.0025 | 0.0036 | 0.001 | — | — | — | — | — | — | — | — | — | — | — | — | — | — | 649 | Comparative steel |
| Q | 0.221 | 0.32 | 2.94 | 0.003 | 0.0008 | 0.0052 | 0.028 | 0.65 | — | — | — | — | — | — | — | — | — | — | — | — | — | 669 | Conforming steel |
| R | 0.187 | 0.17 | 3.60 | 0.027 | 0.0005 | 0.0028 | 0.029 | — | 0.035 | — | — | — | — | — | — | — | — | — | — | — | — | 649 | Conforming steel |
| S | 0.210 | 0.11 | 3.77 | 0.004 | 0.0006 | 0.0038 | 0.045 | — | — | 0.0021 | — | — | — | — | — | — | — | — | — | — | — | 643 | Conforming steel |
| T | 0.098 | 0.09 | 3.52 | 0.004 | 0.0024 | 0.0034 | 0.036 | — | — | — | 0.462 | — | — | — | — | — | — | — | — | — | — | 658 | Conforming steel |
| U | 0.152 | 0.23 | 4.01 | 0.003 | 0.0007 | 0.0028 | 0.034 | — | — | — | — | 0.348 | — | — | — | — | — | — | — | — | — | 637 | Conforming steel |
| V | 0.138 | 0.06 | 3.70 | 0.007 | 0.0016 | 0.0031 | 0.036 | — | — | — | — | — | 0.042 | — | — | — | — | — | — | — | — | 646 | Conforming steel |
| W | 0.144 | 0.52 | 3.12 | 0.003 | 0.0002 | 0.0037 | 0.054 | — | — | — | — | — | — | 0.284 | — | — | — | — | — | — | — | 667 | Conforming steel |
| X | 0.128 | 0.15 | 3.05 | 0.002 | 0.0055 | 0.0048 | 0.018 | — | — | — | — | — | — | — | 0.228 | — | — | — | — | — | — | 665 | Conforming steel |
| Y | 0.132 | 0.22 | 3.62 | 0.045 | 0.0039 | 0.0022 | 0.065 | — | — | — | — | — | — | — | — | 0.009 | — | — | — | — | — | 650 | Conforming steel |
| Z | 0.155 | 1.57 | 3.32 | 0.003 | 0.0009 | 0.0039 | 0.038 | — | — | — | — | — | — | — | — | — | — | 0.006 | — | — | — | 673 | Conforming steel |
| AA | 0.234 | 0.61 | 3.52 | 0.002 | 0.0008 | 0.0042 | 0.012 | — | 0.032 | — | — | — | — | — | — | — | — | — | — | — | — | 655 | Conforming steel |
| AB | 0.124 | 0.42 | 3.28 | 0.005 | 0.0006 | 0.0032 | 0.053 | — | 0.048 | — | — | — | — | — | — | 0.007 | — | — | — | — | — | 662 | Conforming steel |
| AC | 0.233 | 0.23 | 3.89 | 0.035 | 0.0008 | 0.0052 | 0.028 | — | 0.042 | — | — | — | — | — | — | — | — | 0.008 | — | — | — | 641 | Conforming steel |
| AD | 0.068 | 0.08 | 4.06 | 0.003 | 0.0007 | 0.0028 | 0.014 | — | — | — | — | — | — | — | — | — | — | — | 0.0024 | — | — | 637 | Conforming steel |
| AE | 0.114 | 2.41 | 3.89 | 0.004 | 0.0003 | 0.0022 | 0.061 | — | — | — | — | — | — | — | — | — | — | — | — | 0.0022 | — | 667 | Conforming steel |
| AF | 0.216 | 1.25 | 4.14 | 0.003 | 0.0009 | 0.0036 | 0.032 | — | — | — | — | — | — | — | — | — | — | — | — | — | 0.0023 | 645 | Conforming |
| AG | 0.138 | 0.25 | 3.95 | 0.002 | 0.0012 | 0.0034 | 0.016 | — | — | — | — | — | — | — | — | — | 0.009 | — | — | — | — | 641 | steel |

Underline indicates that it is outside the appropriate range.

TABLE 2

| No. | Steel sample ID | Slab heating temperature (° C.) | Hot rolling condition: Finisher delivery temperature (° C.) | Hot rolling condition: Average coiling temperature (° C.) | Hot band annealing condition: Holding temperature (° C.) | Hot band annealing condition: Holding time (s) | Cold rolling condition Rolling reduction (%) |
|---|---|---|---|---|---|---|---|
| 1 | A | 1230 | 910 | 520 | 725 | 20000 | 23.8 |
| 2 | B | 1220 | 880 | 500 | 710 | 18000 | 22.2 |
| 3 | C | 1200 | 850 | 480 | 720 | 16000 | 11.1 |
| 4 | D | 1260 | 920 | 620 | 680 | 20000 | 25.0 |
| 5 | E | 1240 | 860 | 580 | 685 | 21000 | 26.3 |
| 6 | F | 1190 | 890 | 640 | 745 | 15000 | 28.6 |
| 7 | G | 1230 | 930 | 600 | 760 | 13000 | 25.0 |
| 8 | H | 1210 | 880 | 620 | 710 | 14000 | 20.0 |
| 9 | H | 1220 | 640 | 550 | 710 | 16000 | 21.4 |
| 10 | H | 1220 | 1120 | 560 | 720 | 12000 | 22.2 |
| 11 | H | 1260 | 850 | 880 | 725 | 8000 | 27.3 |
| 12 | H | 1250 | 860 | 510 | 550 | 12000 | 26.3 |
| 13 | H | 1210 | 850 | 600 | 850 | 16000 | 25.0 |
| 14 | H | 1220 | 910 | 620 | 710 | 300 | 22.2 |
| 15 | H | 1180 | 860 | 550 | 720 | 20000 | 68.8 |
| 16 | H | 1150 | 880 | 650 | 720 | 8000 | 10.0 |
| 17 | H | 1190 | 820 | 620 | 725 | 11000 | 17.9 |
| 18 | I | 1250 | 840 | 550 | 700 | 19000 | 23.3 |
| 19 | J | 1220 | 890 | 530 | 710 | 8000 | 22.2 |
| 20 | K | 1240 | 940 | 610 | 750 | 17000 | 8.0 |
| 21 | L | 1130 | 850 | 640 | 710 | 15000 | 20.0 |
| 22 | M | 1180 | 950 | 600 | 720 | 17000 | 25.0 |
| 23 | N | 1240 | 810 | 590 | 750 | 19000 | 26.3 |
| 24 | O | 1230 | 900 | 490 | 770 | 9000 | 20.0 |
| 25 | P | 1200 | 840 | 500 | 710 | 5000 | 25.0 |
| 26 | Q | 1240 | 860 | 600 | 740 | 18000 | 27.3 |
| 27 | R | 1230 | 890 | 550 | 715 | 16000 | 22.2 |
| 28 | S | 1220 | 830 | 620 | 710 | 19000 | 22.2 |
| 29 | T | 1190 | 820 | 520 | 720 | 13000 | 28.6 |
| 30 | U | 1250 | 870 | 650 | 700 | 8000 | 27.3 |
| 31 | V | 1200 | 820 | 600 | 710 | 14000 | 25.0 |
| 32 | W | 1230 | 880 | 550 | 730 | 16000 | 26.3 |
| 33 | X | 1220 | 930 | 580 | 730 | 19000 | 18.2 |
| 34 | Y | 1240 | 920 | 520 | 715 | 20000 | 23.8 |
| 35 | Z | 1230 | 880 | 600 | 735 | 20000 | 25.0 |
| 36 | AA | 1200 | 800 | 560 | 720 | 12000 | 28.6 |
| 37 | AB | 1230 | 870 | 550 | 725 | 17000 | 13.0 |
| 38 | AC | 1240 | 790 | 500 | 710 | 6000 | 26.3 |
| 39 | AD | 1230 | 820 | 600 | 705 | 12000 | 27.3 |
| 40 | AE | 1240 | 960 | 620 | 730 | 5000 | 28.0 |
| 41 | AF | 1260 | 900 | 550 | 710 | 10000 | 25.0 |
| 42 | AG | 1230 | 870 | 530 | 710 | 15000 | 14.3 |

| No. | Cold-rolled sheet annealing condition: Holding temperature (° C.) | Cold-rolled sheet annealing condition: Holding time (s) | Alloying temperature of GA (° C.) | Type* | Remarks |
|---|---|---|---|---|---|
| 1 | 715 | 12000 | — | CR | Example |
| 2 | 710 | 20000 | — | CR | Example |
| 3 | 715 | 18000 | 510 | GA | Example |
| 4 | 670 | 9000 | — | CR | Example |
| 5 | 675 | 6000 | — | CR | Example |
| 6 | 735 | 12000 | — | CR | Example |
| 7 | 750 | 10000 | 550 | GA | Example |
| 8 | 700 | 16000 | 490 | GA | Example |
| 9 | 700 | 11000 | — | CR | Comparative example |
| 10 | 710 | 8000 | 500 | GA | Comparative example |
| 11 | 715 | 5000 | — | CR | Comparative example |
| 12 | 700 | 17000 | — | EG | Comparative example |
| 13 | 700 | 15000 | — | CR | Comparative example |
| 14 | 705 | 18000 | — | CR | Comparative example |
| 15 | 710 | 13000 | 505 | GA | Comparative example |
| 16 | 540 | 11000 | — | CR | Comparative example |
| 17 | 840 | 17000 | — | Al | Comparative example |
| 18 | 690 | 12000 | — | CR | Example |
| 19 | 705 | 18000 | — | GI | Example |
| 20 | 740 | 14000 | — | CR | Example |
| 21 | 700 | 8000 | — | CR | Comparative example |

TABLE 2-continued

| | | | | | |
|---|---|---|---|---|---|
| 22 | 715 | 13000 | — | EG | Comparative example |
| 23 | 740 | 14000 | — | CR | Comparative example |
| 24 | 760 | 17000 | — | Al | Comparative example |
| 25 | 705 | 19000 | — | EG | Comparative example |
| 26 | 735 | 18000 | — | CR | Example |
| 27 | 710 | 7000 | 515 | GA | Example |
| 28 | 700 | 16000 | — | Al | Example |
| 29 | 720 | 10000 | — | EG | Example |
| 30 | 690 | 12000 | — | Al | Example |
| 31 | 700 | 8000 | — | CR | Example |
| 32 | 715 | 9000 | — | CR | Example |
| 33 | 720 | 5000 | — | GI | Example |
| 34 | 705 | 2000 | — | EG | Example |
| 35 | 730 | 14000 | — | Al | Example |
| 36 | 710 | 16000 | 530 | GA | Example |
| 37 | 715 | 3000 | — | GI | Example |
| 38 | 700 | 12000 | — | Al | Example |
| 39 | 690 | 5000 | — | CR | Example |
| 40 | 710 | 16000 | — | CR | Example |
| 41 | 695 | 9000 | — | GI | Example |
| 42 | 700 | 12000 | — | CR | Example |

Underline indicates that it is outside the appropriate range.

*CR: cold-rolled sheet (without coating or plating), GI: hot-dip galvanized steel sheet (without alloying treatment on a galvanized layer), GA: galvannealed steel sheet, Al: hot-dip aluminum-coated steel sheet, EG: electrogalvanized steel sheet For each of the steel sheets thus obtained, the cross-sectional microstructure was investigated with the method as described above. The results are listed in Table 3.

TABLE 3

| | | | Steel microstructure | | | | | | | | | | | | | |
|---|---|---|---|---|---|---|---|---|---|---|---|---|---|---|---|---|
| | Steel sample | Sheet thickness | Area ratio of F | Area ratio of M | Volume fraction of RA | Average grain size (μm) | | | Aspect ratio of crystal grain | | | Residual | Mn content in RA | Mn content in F | Mn content in RA/Mn content | |
| No. | ID | (mm) | (%) | (%) | (%) | F | M | RA | F | M | RA | microstructure | (mass %) | (mass %) | in F | Remarks |
| 1 | A | 1.6 | 76.5 | 7.7 | 12.8 | 4.9 | 2.5 | 2.6 | 4.8 | 4.4 | 4.2 | P, θ | 6.71 | 2.66 | 2.52 | Example |
| 2 | B | 1.4 | 62.4 | 14.7 | 19.4 | 3.6 | 1.9 | 1.9 | 4.1 | 3.6 | 3.8 | P, θ | 7.30 | 2.84 | 2.57 | Example |
| 3 | C | 1.6 | 49.5 | 19.7 | 24.9 | 3.1 | 1.1 | 1.2 | 3.8 | 3.4 | 3.2 | P, θ | 8.31 | 3.08 | 2.70 | Example |
| 4 | D | 1.8 | 52.5 | 20.5 | 23.7 | 2.9 | 1.0 | 1.3 | 3.7 | 3.5 | 3.3 | P, θ | 8.14 | 3.02 | 2.70 | Example |
| 5 | E | 1.4 | 77.8 | 8.4 | 10.9 | 4.1 | 2.4 | 2.3 | 3.6 | 3.4 | 3.2 | P, θ | 8.44 | 2.98 | 2.83 | Example |
| 6 | F | 1.0 | 56.4 | 21.5 | 18.5 | 4.4 | 2.1 | 2.6 | 3.5 | 2.9 | 3.1 | P, θ | 6.24 | 2.59 | 2.41 | Example |
| 7 | G | 1.5 | 64.4 | 14.5 | 17.4 | 4.6 | 2.2 | 2.3 | 3.4 | 3.1 | 2.7 | P, θ | 6.12 | 2.45 | 2.50 | Example |
| 8 | H | 1.6 | 53.7 | 22.7 | 20.6 | 2.6 | 1.4 | 1.5 | 3.2 | 2.5 | 2.8 | P, θ | 8.03 | 2.65 | 3.03 | Example |
| 9 | H | 2.2 | 54.6 | 3.89 | 4.4 | 5.2 | 2.1 | 2.2 | 4.7 | 4.3 | 4.1 | F', P, θ | 7.43 | 2.84 | 2.62 | Comparative example |
| 10 | H | 1.4 | 58.2 | 4.9 | 6.7 | 6.8 | 3.8 | 3.5 | 4.2 | 3.1 | 3.3 | F', P, θ | 7.27 | 2.92 | 2.49 | Comparative example |
| 11 | H | 1.6 | 59.1 | 13.6 | 17.9 | 7.8 | 4.4 | 4.3 | 3.1 | 3.2 | 3.1 | P, θ | 6.83 | 2.89 | 2.36 | Comparative example |
| 12 | H | 1.4 | 62.2 | 16.3 | 6.1 | 5.1 | 2.1 | 1.8 | 2.9 | 2.6 | 2.4 | P, θ | 5.22 | 3.58 | 1.46 | Comparative example |
| 13 | H | 1.8 | 63.1 | 18.9 | 5.2 | 4.6 | 1.5 | 1.4 | 3.0 | 2.4 | 2.5 | P, θ | 5.28 | 3.42 | 1.54 | Comparative example |
| 14 | H | 1.4 | 62.9 | 17.4 | 6.4 | 4.7 | 1.8 | 1.3 | 2.9 | 2.5 | 2.4 | P, θ | 5.37 | 3.62 | 1.48 | Comparative example |
| 15 | H | 1.0 | 68.2 | 16.9 | 8.4 | 4.0 | 2.4 | 2.8 | 3.4 | 1.2 | 1.3 | P, θ | 7.04 | 2.81 | 2.51 | Comparative example |
| 16 | H | 1.8 | 47.4 | 3.3 | 2.9 | 6.9 | 3.7 | 2.4 | 2.8 | 3.2 | 2.7 | TM, θ | 5.64 | 3.61 | 1.56 | Comparative example |
| 17 | H | 2.3 | 20.4 | 53.1 | 4.2 | 7.8 | 3.9 | 4.1 | 3.8 | 3.1 | 2.9 | TM, P, θ | 5.51 | 3.73 | 1.48 | Comparative example |
| 18 | I | 2.3 | 62.8 | 16.4 | 17.6 | 3.9 | 1.3 | 1.6 | 3.3 | 2.9 | 3.1 | P, θ | 8.32 | 2.98 | 2.79 | Example |
| 19 | J | 1.4 | 61.5 | 18.1 | 18.2 | 4.1 | 1.8 | 1.7 | 3.4 | 2.8 | 2.8 | P, θ | 8.28 | 2.92 | 2.84 | Example |
| 20 | K | 2.3 | 78.5 | 7.9 | 11.2 | 4.9 | 2.3 | 2.7 | 4.7 | 4.1 | 4.0 | P, θ | 6.71 | 2.66 | 2.52 | Example |
| 21 | L | 1.2 | 89.1 | 3.2 | 3.9 | 7.8 | 0.6 | 0.4 | 3.3 | 2.4 | 2.3 | P, θ | 6.38 | 2.76 | 2.31 | Comparative example |
| 22 | M | 1.8 | 23.4 | 38.3 | 31.2 | 4.7 | 4.0 | 3.8 | 4.1 | 3.6 | 3.5 | P, θ | 7.32 | 2.79 | 2.62 | Comparative example |

TABLE 3-continued

| | | | Steel microstructure | | | | | | | | | | | | | |
|---|---|---|---|---|---|---|---|---|---|---|---|---|---|---|---|---|
| | Steel sample | Sheet thickness | Area ratio of F | Area ratio of M | Volume fraction of RA | Average grain size (μm) | | | Aspect ratio of crystal grain | | | Residual | Mn content in RA | Mn content in F | Mn content in RA/ Mn content | |
| No. | ID | (mm) | (%) | (%) | (%) | F | M | RA | F | M | RA | microstructure | (mass %) | (mass %) | in F | Remarks |
| 23 | N | 1.4 | 53.5 | 19.8 | 24.1 | 5.2 | 4.1 | 3.7 | 4.1 | 3.2 | 3.6 | P, θ | 7.27 | 2.88 | 2.52 | Comparative example |
| 24 | O | 1.6 | 85.2 | 4.3 | 3.9 | 6.8 | 4.2 | 4.2 | 3.9 | 3.5 | 3.1 | P, θ | 3.52 | 2.12 | 1.66 | Comparative example |
| 25 | P | 1.8 | 59.9 | 16.7 | 18.2 | 7.1 | 4.3 | 4.4 | 3.4 | 3.3 | 4.1 | P, θ | 7.31 | 2.84 | 2.57 | Comparative example |
| 26 | Q | 1.6 | 55.4 | 19.6 | 22.1 | 4.3 | 1.5 | 1.8 | 2.9 | 2.6 | 2.7 | P, θ | 6.11 | 2.53 | 2.42 | Example |
| 27 | R | 1.4 | 56.8 | 21.3 | 18.2 | 4.2 | 1.4 | 1.3 | 3.2 | 2.5 | 2.4 | P, θ | 7.24 | 2.52 | 2.87 | Example |
| 28 | S | 1.4 | 54.5 | 21.5 | 20.5 | 4.1 | 1.2 | 1.1 | 2.8 | 2.3 | 2.7 | P, θ | 6.89 | 2.49 | 2.77 | Example |
| 29 | T | 1.0 | 66.4 | 14.1 | 17.2 | 4.5 | 2.1 | 1.8 | 3.4 | 3.1 | 2.8 | P, θ | 6.56 | 2.45 | 2.68 | Example |
| 30 | U | 0.8 | 56.2 | 21.1 | 18.3 | 4.3 | 1.1 | 1.3 | 3.1 | 2.9 | 3.2 | P, θ | 6.24 | 2.56 | 2.44 | Example |
| 31 | V | 1.2 | 61.5 | 15.5 | 19.7 | 4.6 | 1.4 | 1.6 | 3.5 | 2.5 | 2.7 | P, θ | 6.41 | 2.85 | 2.25 | Example |
| 32 | W | 1.4 | 64.3 | 13.5 | 19.4 | 3.8 | 1.9 | 2.2 | 3.1 | 3.1 | 2.8 | P, θ | 6.32 | 2.65 | 2.38 | Example |
| 33 | X | 1.8 | 72.4 | 12.8 | 13.4 | 4.1 | 2.4 | 2.6 | 3.8 | 2.7 | 2.2 | P, θ | 6.11 | 2.53 | 2.42 | Example |
| 34 | Y | 1.6 | 63.6 | 14.7 | 17.2 | 4.2 | 2.1 | 1.8 | 3.4 | 2.8 | 2.6 | P, θ | 6.94 | 2.59 | 2.68 | Example |
| 35 | Z | 1.2 | 66.1 | 15.9 | 14.7 | 4.0 | 1.9 | 1.6 | 3.5 | 3.0 | 2.7 | P, θ | 7.02 | 2.61 | 2.69 | Example |
| 36 | AA | 1.0 | 54.3 | 22.7 | 20.3 | 3.8 | 1.2 | 1.4 | 3.1 | 2.7 | 3.1 | P, θ | 6.38 | 2.42 | 2.64 | Example |
| 37 | AB | 2.0 | 67.6 | 14.2 | 13.9 | 4.2 | 1.7 | 1.8 | 3.4 | 3.1 | 2.5 | P, θ | 6.02 | 2.65 | 2.27 | Example |
| 38 | AC | 1.4 | 56.1 | 21.3 | 19.6 | 3.7 | 1.3 | 1.5 | 2.9 | 2.9 | 2.4 | P, θ | 7.24 | 2.59 | 2.80 | Example |
| 39 | AD | 1.6 | 67.1 | 14.8 | 16.2 | 4.4 | 2.2 | 1.7 | 3.1 | 2.5 | 2.7 | P, θ | 7.02 | 2.45 | 2.87 | Example |
| 40 | AE | 1.8 | 57.3 | 20.7 | 19.8 | 3.5 | 1.4 | 1.3 | 3.5 | 3.8 | 4.1 | P, θ | 7.12 | 2.58 | 2.76 | Example |
| 41 | AF | 1.2 | 57.5 | 20.3 | 21.1 | 4.1 | 1.2 | 1.4 | 3.7 | 3.5 | 3.3 | P, θ | 7.28 | 2.54 | 2.87 | Example |
| 42 | AG | 1.2 | 56.2 | 20.5 | 20.7 | 3.4 | 1.4 | 1.5 | 3.4 | 3.2 | 3.6 | P, θ | 7.04 | 2.69 | 2.62 | Example |

Underline indicates that it is outside the appropriate range.
F: ferrite,
F': unrecrystallized ferrite,
RA: retained austenite,
M: martensite,
TM: tempered martensite
P: pearlite,
θ: carbide (cementite, etc.)

Additionally, for each of the steel sheets thus obtained, a tensile test and hole expanding test were performed to evaluate the tensile property and hole expansion formability in the following way.

The tensile test was performed in accordance with JIS Z 2241 (2011) to measure the yield stress (YP), yield ratio (YR), tensile strength (TS), and total elongation (EL) using JIS No. 5 test pieces, each of which was taken as a sample in a manner where the tensile direction was perpendicular to the rolling direction of the steel sheet. Note that YR is a value expressed as a percentage obtained by dividing YP by TS.

It was determined to be good when YR<68%, TS≥590 MPa or more, TS×EL≥24000 MPa·%, and EL≥34% for a steel sheet of TS 590 MPa grade, EL≥30% for a steel sheet of TS 780 MPa grade, and EL≥24% for a steel sheet of TS 980 MPa grade.

Note that a steel sheet of TS 590 MPa grade refers to a steel sheet with a TS of 590 MPa or more and less than 780 MPa, a steel sheet of TS 780 MPa grade refers to a steel sheet with a TS of 780 MPa or more and less than 980 MPa, and a steel sheet of TS 980 MPa grade refers to a steel sheet with a TS of 980 MPa or more and less than 1180 MPa.

The hole expanding test was performed in accordance with JIS Z 2256 (2010). The steel sheets thus obtained were each cut to a sample size of 100 mm×100 mm, and a hole with a diameter of 10 mm was punched through each sample with a clearance of 12%±1%. Subsequently, each steel sheet was clamped into a die having an inner diameter of 75 mm with a blank holding force of 9 tons (88.26 kN). In this state, a conical punch of 60° was pushed into the hole, and the hole diameter at crack initiation limit was measured. Subsequently, the maximum hole expansion ratio λ (%) was determined in the following way, and the hole expansion formability was evaluated based on the value of the maximum hole expansion ratio.

$$\text{Maximum hole expansion ratio } \lambda(\%)=\{(D_f-D_0)/D_0\}\times 100$$

where $D_f$ is the hole diameter (mm) when cracking occurs, and $D_0$ is the initial hole diameter (mm).

The hole expansion formability was determined to be good when λ≥30% for a steel sheet of TS 590 MPa grade, λ≥25% for a steel sheet of TS 780 MPa grade, and λ≥20% for a steel sheet of TS 980 MPa grade.

Furthermore, the tensile test was stopped halfway when the elongation value reached 10%, and the surface roughness Ra of each test piece was measured. Ra was measured in accordance with JIS B 0601 (2013). When stretcher strain became pronounced, Ra was more than 2.00 μm. Therefore, it was determined to be good when Ra≤2.00 μm.

Moreover, during the production of the steel sheets, measurements were performed on productivity, sheet passage ability during hot rolling and cold rolling, and surface characteristics of final-annealed sheets (steel sheets after subjection to cold-rolled sheet annealing).

The productivity was evaluated according to the lead time costs, including:

(1) malformation occurred in the hot-rolled sheet;

(2) the hot-rolled sheet required shape adjustment before proceeding to the subsequent process; and (3) the holding time of annealing treatment was long.

The productivity was determined to be 'good' when none of (1) to (3) applied and 'poor' when any of (1) to (3) applied.

The sheet passage ability during hot rolling was determined to be poor when the risk of occurrence of trouble during rolling increased due to an increased rolling load.

The sheet passage ability during cold rolling was also determined to be poor when the risk of occurrence of trouble during rolling increased due to an increased rolling load, as the case of hot rolling.

The surface characteristics of each final-annealed sheet were determined to be poor when defects such as blow hole and segregation on the slab surface layer could not be scaled-off, the number of cracks and irregularities on the steel sheet surface increased, and a smooth steel sheet surface could not be obtained. The surface characteristics were also determined to be poor when the amount of oxides (scales) generated suddenly increased, the interface between the steel substrate and oxides was rough, and the surface quality after pickling and cold rolling deteriorated, or when some hot-rolling scales remained after pickling.

The evaluation results are listed in Table 4.

TABLE 4

| No. | Tensile test result YP (MPa) | YR (%) | TS (MPa) | EL (%) | TS × EL (MPa · %) | Hole expansion test result λ (%) | Surface roughness after 10% tension Ra (μm) | Productivity | Sheet passage ability during hot rolling | Sheet passage ability during cold rolling | Surface characteristics of final-annealed sheet | Remarks |
|---|---|---|---|---|---|---|---|---|---|---|---|---|
| 1 | 389 | 61.6 | 632 | 38.5 | 24332 | 47 | 1.02 | Good | Good | Good | Good | Example |
| 2 | 457 | 56.5 | 809 | 32.8 | 26535 | 38 | 0.97 | Good | Good | Good | Good | Example |
| 3 | 620 | 61.3 | 1011 | 26.9 | 27196 | 32 | 1.26 | Good | Good | Good | Good | Example |
| 4 | 635 | 62.1 | 1022 | 26.8 | 27390 | 33 | 1.22 | Good | Good | Good | Good | Example |
| 5 | 376 | 57.5 | 654 | 37.3 | 24394 | 40 | 1.18 | Good | Good | Good | Good | Example |
| 6 | 607 | 61.4 | 989 | 27.7 | 27395 | 28 | 1.34 | Good | Good | Good | Good | Example |
| 7 | 486 | 59.9 | 812 | 33.1 | 26877 | 29 | 1.63 | Good | Good | Good | Good | Example |
| 8 | 651 | 64.6 | 1007 | 27.2 | 27390 | 30 | 1.27 | Good | Good | Good | Good | Example |
| 9 | 350 | 62.9 | 556 | 30.8 | 17125 | 18 | 2.31 | Poor | Poor | Poor | Poor | Comparative example |
| 10 | 349 | 61.4 | 568 | 31.5 | 17892 | 19 | 2.46 | Poor | Good | Poor | Poor | Comparative example |
| 11 | 320 | 58.7 | 545 | 31.2 | 17004 | 18 | 1.16 | Good | Good | Good | Good | Comparative example |
| 12 | 325 | 56.6 | 574 | 33.1 | 18999 | 17 | 1.59 | Good | Good | Poor | Good | Comparative example |
| 13 | 338 | 60.0 | 563 | 30.7 | 17284 | 19 | 1.12 | Good | Good | Good | Good | Comparative example |
| 14 | 326 | 59.2 | 551 | 31.1 | 17136 | 18 | 1.08 | Good | Good | Poor | Good | Comparative example |
| 15 | 616 | 62.3 | 989 | 25.1 | 24824 | 17 | 2.47 | Good | Good | Good | Good | Comparative example |
| 16 | 515 | 88.3 | 583 | 31.6 | 18423 | 40 | 1.27 | Good | Good | Good | Good | Comparative example |
| 17 | 651 | 64.3 | 1012 | 18.7 | 18924 | 33 | 1.07 | Poor | Good | Good | Good | Comparative example |
| 18 | 653 | 64.3 | 1016 | 27.6 | 28042 | 30 | 1.19 | Good | Good | Good | Good | Example |
| 19 | 629 | 61.5 | 1022 | 27.0 | 27594 | 28 | 1.35 | Good | Good | Good | Good | Example |
| 20 | 378 | 57.4 | 658 | 37.9 | 24938 | 38 | 0.87 | Good | Good | Good | Good | Example |
| 21 | 120 | 22.0 | 545 | 32.0 | 17440 | 42 | 0.96 | Good | Good | Good | Good | Comparative example |
| 22 | 705 | 61.1 | 1153 | 15.6 | 17987 | 12 | 1.22 | Good | Good | Good | Good | Comparative example |
| 23 | 625 | 63.3 | 988 | 18.9 | 18673 | 10 | 2.38 | Good | Good | Good | Poor | Comparative example |
| 24 | 342 | 59.6 | 574 | 30.2 | 17335 | 34 | 1.14 | Good | Good | Good | Good | Comparative example |
| 25 | 318 | 54.6 | 582 | 41.4 | 24095 | 33 | 1.35 | Good | Good | Good | Good | Comparative example |
| 26 | 622 | 62.6 | 994 | 28.1 | 27931 | 33 | 1.12 | Good | Good | Good | Good | Example |
| 27 | 618 | 61.4 | 1007 | 27.7 | 27894 | 28 | 1.27 | Good | Good | Good | Good | Example |
| 28 | 657 | 60.7 | 1082 | 26.9 | 29106 | 27 | 1.17 | Good | Good | Good | Good | Example |
| 29 | 504 | 59.6 | 846 | 35.5 | 30033 | 32 | 1.34 | Good | Good | Good | Good | Example |
| 30 | 639 | 64.1 | 997 | 28.9 | 28813 | 28 | 1.26 | Good | Good | Good | Good | Example |
| 31 | 604 | 61.3 | 986 | 29.6 | 29186 | 29 | 1.02 | Good | Good | Good | Good | Example |
| 32 | 428 | 54.2 | 789 | 37.6 | 29666 | 29 | 1.08 | Good | Good | Good | Good | Example |
| 33 | 390 | 59.7 | 653 | 36.2 | 23639 | 45 | 0.97 | Good | Good | Good | Good | Example |
| 34 | 512 | 61.3 | 835 | 34.5 | 28808 | 34 | 1.34 | Good | Good | Good | Good | Example |
| 35 | 508 | 60.3 | 842 | 33.8 | 28460 | 32 | 1.25 | Good | Good | Good | Good | Example |
| 36 | 662 | 61.6 | 1074 | 34.9 | 37483 | 30 | 1.54 | Good | Good | Good | Good | Example |
| 37 | 512 | 61.3 | 835 | 34.2 | 28557 | 28 | 1.06 | Good | Good | Good | Good | Example |
| 38 | 649 | 59.4 | 1092 | 28.3 | 30904 | 24 | 1.43 | Good | Good | Good | Good | Example |
| 39 | 508 | 62.6 | 812 | 33.9 | 27527 | 32 | 1.17 | Good | Good | Good | Good | Example |
| 40 | 629 | 63.3 | 993 | 29.9 | 29691 | 29 | 1.22 | Good | Good | Good | Good | Example |
| 41 | 657 | 61.2 | 1073 | 27.5 | 29508 | 28 | 1.18 | Good | Good | Good | Good | Example |
| 42 | 619 | 62.9 | 984 | 28.7 | 28241 | 34 | 0.89 | Good | Good | Good | Good | Example |

According to Table 4, it can be understood that all examples according to the present disclosure were high-strength steel sheets that had a tensile strength (TS) of 590 MPa or more, a yield ratio (YR) of less than 68%, good ductility, good balance between strength and ductility, and excellent hole expansion formability. It can also be understood that all examples according to the present disclosure exhibited excellent productivity, excellent sheet passage ability during hot rolling and cold rolling, and excellent surface characteristics as final-annealed sheets.

In contrast, the comparative examples failed to provide desired properties in at least one of the tensile strength, yield ratio, ductility, balance between strength and ductility, or hole expansion formability.

INDUSTRIAL APPLICABILITY

According to the present disclosure, it is possible to produce a high-strength steel sheet with excellent ductility and hole expansion formability and a low yield ratio, where the yield ratio (YR) is less than 68% and the tensile strength (TS) is 590 MPa or more.

The high-strength steel sheet of the present disclosure is highly beneficial in industrial terms, because it can reduce the automotive body weight and thereby improve the fuel efficiency when applied to, for example, an automobile structural part.

The invention claimed is:

1. A high-strength steel sheet comprising:

a chemical composition consisting of, by mass %,
- C: 0.030% or more and 0.250% or less,
- Si: 0.01% or more and 3.00% or less,
- Mn: 2.60% or more and 4.20% or less,
- P: 0.001% or more and 0.100% or less,
- S: 0.0001% or more and 0.0200% or less,
- N: 0.0005% or more and 0.0100% or less, and
- Ti: 0.003% or more and 0.200% or less, and
- optionally at least one selected from
  - Al: 0.01% or more and 2.00% or less,
  - Nb: 0.005% or more and 0.200% or less,
  - B: 0.0003% or more and 0.0050% or less,
  - Ni: 0.005% or more and 1.000% or less,
  - Cr: 0.005% or more and 1.000% or less,
  - V: 0.005% or more and 0.500% or less,
  - Mo: 0.005% or more and 1.000% or less,
  - Cu: 0.005% or more and 1.000% or less,
  - Sn: 0.002% or more and 0.200% or less,
  - Sb: 0.002% or more and 0.200% or less,
  - Ta: 0.001% or more and 0.010% or less,
  - Ca: 0.0005% or more and 0.0050% or less,
  - Mg: 0.0005% or more and 0.0050% or less, or
  - REM: 0.0005% or more and 0.0050% or less, and the balance being Fe and inevitable impurities, and a microstructure where
- ferrite is 35% or more and 80% or less in area ratio,
- martensite is 5% or more and 25% or less in area ratio, and
- retained austenite is 8% or more in volume fraction, wherein an average grain size of the ferrite is 6.0 μm or less, an average grain size of the martensite is 3.0 μm or less, an average grain size of the retained austenite is 3.0 μm or less, an average aspect ratio of crystal grain of each of the ferrite, the martensite and the retained austenite is more than 2.2 and 15.0 or less, a value obtained by dividing a Mn content (mass %) in the retained austenite by a Mn content (mass %) in the ferrite is 2.0 or more, and the high-strength steel sheet has a tensile strength of 590 MPa or more and a yield ratio of less than 68%.

2. The high-strength steel sheet according to claim 1, comprising a hot-dip galvanized layer on a surface.

3. The high-strength steel sheet according to claim 1, comprising a hot-dip aluminum-coated layer on a surface.

4. The high-strength steel sheet according to claim 1, comprising an electrogalvanized layer on a surface.

5. A method for producing the high-strength steel sheet according to claim 1, comprising:

(i) subjecting a steel slab to hot rolling, in which the steel slab is heated to 1100° C. or higher and 1300° C. or lower, hot rolled with a finisher delivery temperature of 750° C. or higher and 1000° C. or lower, and coiled at an average coiling temperature of 300° C. or higher and 750° C. or lower to obtain a hot-rolled sheet;

(ii) subjecting the hot-rolled sheet to pickling, in which scales are removed;

(iii) subjecting the hot-rolled sheet to hot band annealing, in which the hot-rolled sheet is held in a temperature range of ($Ac_1$ transformation point+20° C.) or higher and ($Ac_1$ transformation point+120° C.) or lower for 600 seconds or more and 21600 seconds or less;

(iv) subjecting the hot-rolled sheet to cold rolling, in which the hot-rolled sheet is cold rolled with a rolling reduction of 3% or more and less than 30% to obtain a cold-rolled sheet; and (v) subjecting the cold-rolled sheet to cold-rolled sheet annealing, in which the cold-rolled sheet is held in a temperature range of ($Ac_1$ transformation point+10° C.) or higher and ($Ac_1$ transformation point+100° C.) or lower for more than 900 seconds and 21600 seconds or less and then cooled, wherein the steel slab has a chemical composition consisting of, by mass %,
- C: 0.030% or more and 0.250% or less,
- Si: 0.01% or more and 3.00% or less,
- Mn: 2.60% or more and 4.20% or less,
- P: 0.001% or more and 0.100% or less,
- S: 0.0001% or more and 0.0200% or less,
- N: 0.0005% or more and 0.0100% or less, and
- Ti: 0.003% or more and 0.200% or less, and
- optionally at least one selected from
  - Al: 0.01% or more and 2.00% or less,
  - Nb: 0.005% or more and 0.200% or less,
  - B: 0.0003% or more and 0.0050% or less,
  - Ni: 0.005% or more and 1.000% or less,
  - Cr: 0.005% or more and 1.000% or less,
  - V: 0.005% or more and 0.500% or less,
  - Mo: 0.005% or more and 1.000% or less,
  - Cu: 0.005% or more and 1.000% or less,
  - Sn: 0.002% or more and 0.200% or less,
  - Sb: 0.002% or more and 0.200% or less,
  - Ta: 0.001% or more and 0.010% or less,
  - Ca: 0.0005% or more and 0.0050% or less,
  - Mg: 0.0005% or more and 0.0050% or less, or
  - REM: 0.0005% or more and 0.0050% or less, and the balance being Fe and inevitable impurities.

6. A method for producing the high-strength steel sheet according to claim 2, comprising:

(i) subjecting a steel slab to hot rolling, in which the steel slab is heated to 1100° C. or higher and 1300° C. or lower, hot rolled with a finisher delivery temperature of 750° C. or higher and 1000° C. or lower, and coiled at an average coiling temperature of 300° C. or higher and 750° C. or lower to obtain a hot-rolled sheet;

(ii) subjecting the hot-rolled sheet to pickling, in which scales are removed;

(iii) subjecting the hot-rolled sheet to hot band annealing, in which the hot-rolled sheet is held in a temperature range of ($Ac_1$ transformation point+20° C.) or higher and ($Ac_1$ transformation point+120° C.) or lower for 600 seconds or more and 21600 seconds or less;

(iv) subjecting the hot-rolled sheet to cold rolling, in which the hot-rolled sheet is cold rolled with a rolling reduction of 3% or more and less than 30% to obtain a cold-rolled sheet; and (v) subjecting the cold-rolled sheet to cold-rolled sheet annealing, in which the cold-rolled sheet is held in a temperature range of ($Ac_1$ transformation point+10° C.) or higher and ($Ac_1$ transformation point+100° C.) or lower for more than 900 seconds and 21600 seconds or less and then cooled, after (v) the cold-rolled sheet annealing, the cold-rolled sheet is further subjected to hot-dip galvanizing treatment, or after (v) the cold-rolled sheet annealing, the cold-rolled sheet is further subjected to hot-dip galvanizing treatment, and then to alloying treatment in a temperature range of 450° C. or higher and 600° C. or lower, wherein the steel slab has a chemical composition consisting of, by mass %, C: 0.030% or more and 0.250% or less,
Si: 0.01% or more and 3.00% or less,
Mn: 2.60% or more and 4.20% or less,
P: 0.001% or more and 0.100% or less,
S: 0.0001% or more and 0.0200% or less,
N: 0.0005% or more and 0.0100% or less, and
Ti: 0.003% or more and 0.200% or less, and
optionally at least one selected from
Al: 0.01% or more and 2.00% or less,
Nb: 0.005% or more and 0.200% or less,
B: 0.0003% or more and 0.0050% or less,
Ni: 0.005% or more and 1.000% or less,
Cr: 0.005% or more and 1.000% or less,
V: 0.005% or more and 0.500% or less,
Mo: 0.005% or more and 1.000% or less,
Cu: 0.005% or more and 1.000% or less,
Sn: 0.002% or more and 0.200% or less,
Sb: 0.002% or more and 0.200% or less,
Ta: 0.001% or more and 0.010% or less,
Ca: 0.0005% or more and 0.0050% or less,
Mg: 0.0005% or more and 0.0050% or less, or
REM: 0.0005% or more and 0.0050% or less, and
the balance being Fe and inevitable impurities.

7. A method for producing the high-strength steel sheet according to claim 3, comprising:

(i) subjecting a steel slab to hot rolling, in which the steel slab is heated to 1100° C. or higher and 1300° C. or lower, hot rolled with a finisher delivery temperature of 750° C. or higher and 1000° C. or lower, and coiled at an average coiling temperature of 300° C. or higher and 750° C. or lower to obtain a hot-rolled sheet;

(ii) subjecting the hot-rolled sheet to pickling, in which scales are removed;

(iii) subjecting the hot-rolled sheet to hot band annealing, in which the hot-rolled sheet is held in a temperature range of ($Ac_1$ transformation point+20° C.) or higher and ($Ac_1$ transformation point+120° C.) or lower for 600 seconds or more and 21600 seconds or less;

(iv) subjecting the hot-rolled sheet to cold rolling, in which the hot-rolled sheet is cold rolled with a rolling reduction of 3% or more and less than 30% to obtain a cold-rolled sheet; and (v) subjecting the cold-rolled sheet to cold-rolled sheet annealing, in which the cold-rolled sheet is held in a temperature range of ($Ac_1$ transformation point+10° C.) or higher and ($Ac_1$ transformation point+100° C.) or lower for more than 900 seconds and 21600 seconds or less and then cooled, after (v) the cold-rolled sheet annealing, the cold-rolled sheet is further subjected to hot-dip aluminum-coating treatment, wherein the steel slab has a chemical composition consisting of, by mass %, C: 0.030% or more and 0.250% or less,
Si: 0.01% or more and 3.00% or less,
Mn: 2.60% or more and 4.20% or less,
P: 0.001% or more and 0.100% or less,
S: 0.0001% or more and 0.0200% or less,
N: 0.0005% or more and 0.0100% or less, and
Ti: 0.003% or more and 0.200% or less, and
optionally at least one selected from
Al: 0.01% or more and 2.00% or less,
Nb: 0.005% or more and 0.200% or less,
B: 0.0003% or more and 0.0050% or less,
Ni: 0.005% or more and 1.000% or less,
Cr: 0.005% or more and 1.000% or less,
V: 0.005% or more and 0.500% or less,
Mo: 0.005% or more and 1.000% or less,
Cu: 0.005% or more and 1.000% or less,
Sn: 0.002% or more and 0.200% or less,
Sb: 0.002% or more and 0.200% or less,
Ta: 0.001% or more and 0.010% or less,
Ca: 0.0005% or more and 0.0050% or less,
Mg: 0.0005% or more and 0.0050% or less, or
REM: 0.0005% or more and 0.0050% or less, and
the balance being Fe and inevitable impurities.

8. A method for producing the high-strength steel sheet according to claim 4, comprising (i) subjecting a steel slab to hot rolling, in which the steel slab is heated to 1100° C. or higher and 1300° C. or lower, hot rolled with a finisher delivery temperature of 750° C. or higher and 1000° C. or lower, and coiled at an average coiling temperature of 300° C. or higher and 750° C. or lower to obtain a hot-rolled sheet;

(ii) subjecting the hot-rolled sheet to pickling, in which scales are removed;

(iii) subjecting the hot-rolled sheet to hot band annealing, in which the hot-rolled sheet is held in a temperature range of ($Ac_1$ transformation point+20° C.) or higher and ($Ac_1$ transformation point+120° C.) or lower for 600 seconds or more and 21600 seconds or less;

(iv) subjecting the hot-rolled sheet to cold rolling, in which the hot-rolled sheet is cold rolled with a rolling reduction of 3% or more and less than 30% to obtain a cold-rolled sheet; and (v) subjecting the cold-rolled sheet to cold-rolled sheet annealing, in which the cold-rolled sheet is held in a temperature range of ($Ac_1$ transformation point+10° C.) or higher and ($Ac_1$ transformation point+100° C.) or lower for more than 900 seconds and 21600 seconds or less and then cooled, after (v) the cold-rolled sheet annealing, the cold-rolled sheet is further subjected to electrogalvanizing treatment, wherein the steel slab has a chemical composition consisting of, by mass %, C: 0.030% or more and 0.250% or less,
Si: 0.01% or more and 3.00% or less,
Mn: 2.60% or more and 4.20% or less,
P: 0.001% or more and 0.100% or less,
S: 0.0001% or more and 0.0200% or less,
N: 0.0005% or more and 0.0100% or less, and
Ti: 0.003% or more and 0.200% or less, and
optionally at least one selected from
Al: 0.01% or more and 2.00% or less,
Nb: 0.005% or more and 0.200% or less,
B: 0.0003% or more and 0.0050% or less,
Ni: 0.005% or more and 1.000% or less,
Cr: 0.005% or more and 1.000% or less,
V: 0.005% or more and 0.500% or less,
Mo: 0.005% or more and 1.000% or less,
Cu: 0.005% or more and 1.000% or less,
Sn: 0.002% or more and 0.200% or less,
Sb: 0.002% or more and 0.200% or less,
Ta: 0.001% or more and 0.010% or less,
Ca: 0.0005% or more and 0.0050% or less,
Mg: 0.0005% or more and 0.0050% or less, or
REM: 0.0005% or more and 0.0050% or less, and
the balance being Fe and inevitable impurities.

9. The high-strength steel sheet according to claim 1, wherein the average aspect ratio of crystal grain of each of the ferrite, the martensite and the retained austenite is more than 2.4 and 15.0 or less.

* * * * *